US005423184A

United States Patent [19]

Eggemar

[11] Patent Number: 5,423,184

[45] Date of Patent: Jun. 13, 1995

[54] METHOD AND AN ARRANGEMENT FOR MEASURING AND ADJUSTING THE ICE TEMPERATURE OF ARTIFICIAL ICE RINKS

[76] Inventor: Bengt V. Eggemar, Torparmore vag 6, S-162 45 Vallingby, Sweden

[21] Appl. No.: 142,488

[22] PCT Filed: May 27, 1992

[86] PCT No.: PCT/SE92/00360

§ 371 Date: Nov. 29, 1993

§ 102(e) Date: Nov. 29, 1993

[87] PCT Pub. No.: WO92/22026

PCT Pub. Date: Dec. 10, 1992

[30] Foreign Application Priority Data

May 28, 1991 [SE] Sweden ..... 9101/623

[51] Int. Cl.[6] ..... F25D 29/00

[52] U.S. Cl. ..... 62/140; 62/235; 374/121; 340/581

[58] Field of Search ..... 62/139, 140, 235, 260, 62/158, 129, 231; 374/121, 133; 340/580, 581, 583

[56] References Cited

U.S. PATENT DOCUMENTS

| | | | |
|---|---|---|---|
| 4,270,361 | 6/1981 | La Barge | 62/158 |
| 4,690,553 | 9/1987 | Fukamizu et al. | 358/51 |
| 4,700,548 | 10/1987 | Roche et al. | 62/139 |
| 4,807,443 | 2/1989 | Battson et al. | 62/231 X |

FOREIGN PATENT DOCUMENTS

| | | | |
|---|---|---|---|
| 1150107 | 6/1963 | Germany . | |
| 2-146481 | 6/1990 | Japan | 62/129 |

*Primary Examiner*—Harry B. Tanner
*Attorney, Agent, or Firm*—Nixon & Vanderhye

[57] ABSTRACT

A method for measuring and adjusting the temperature of surface ice in artificial ice rinks, in which water is frozen to ice with the aid of refrigerating channels arranged in the rink and through which refrigerant is passed a by means of a refrigerating system and wherein the temperature of the ice is controlled by controlling the refrigerating power of the refrigerating system. The method is mainly characterized in that the surface ice temperature is measured with the aid of at least one sensor, which functions to measure infrared radiation from the surface ice. The signals produced by the sensor are processed in a control unit which controls the refrigeration system in a manner to bring the surface ice to a predetermined temperature. The invention also related to an arrangement for carrying out the method.

17 Claims, 1 Drawing Sheet

Figure 1:
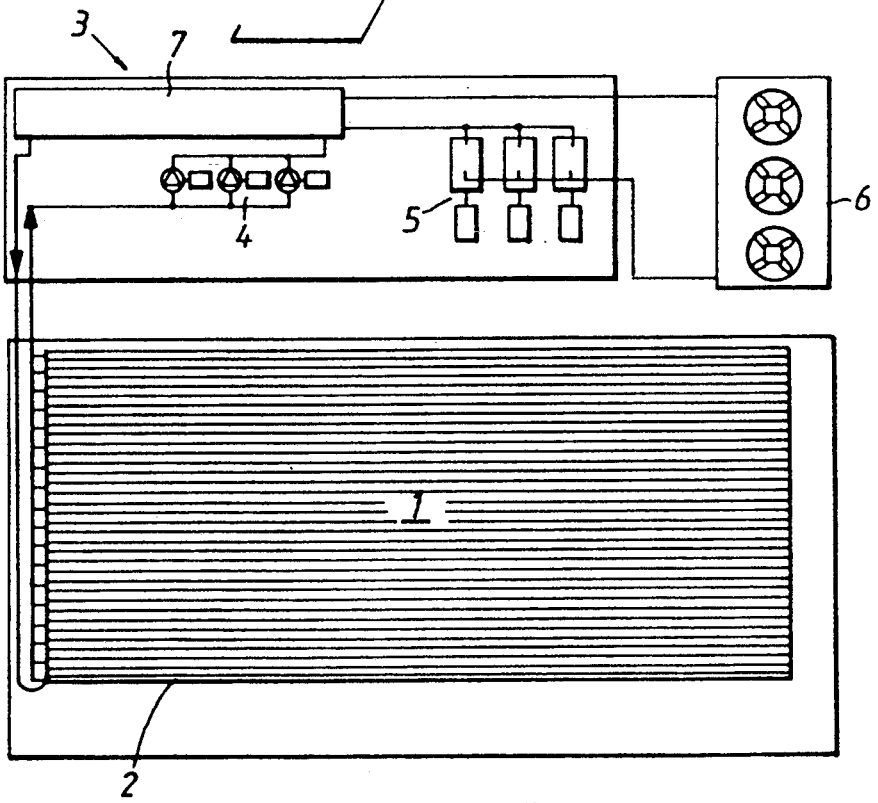

METHOD AND AN ARRANGEMENT FOR MEASURING AND ADJUSTING THE ICE TEMPERATURE OF ARTIFICIAL ICE RINKS

The present invention relates to a method for measuring the temperature of the ice of artificial ice rinks where water is frozen to ice with the aid of cooling channels arranged in the rink and through which refrigerant is passed by means of a refrigerating system, the temperature of the ice being controlled by regulating the refrigerating effect or refrigerating capacity of the refrigerating system.

The invention also relates to a refrigerating system for carrying out the method.

The surface ice of an artificial ice rink has keen found to generate the lowest friction in contact with the runners of ice skates when the temperature of the surface ice is precisely −2° C. The surface ice is softer at higher temperatures and the skate runners will therefore bite deeper into the ice. At lower temperatures, the ice is hard and affords a poor grip to the skate runners, besides becoming rougher as a result of the small ice crystals that form on the ice surface from the moisture contained in the air. Measurements show a marked change in friction precisely at a temperature of −2° C.

At lower surface ice temperatures, the surface will also absorb more heat from the ambient air and incident heat energy from atmosphere or from the ceiling of an enclosed ice rink. The increased heat load at excessively low surface temperatures has been measured to about 11 W/square meters and degree Celsius. Thus, in the case of an icehockey rink whose surface temperate is too low by 1° C. and which has an area of 1900 square meters, the heat load and refrigerating power requirement is about 21 kW. It will be seen from this that in a normal playing (operating) season of eight months, the refrigerating energy requirement will increase by about 120,000 kWh.

Artificially frozen ice rinks are constructed with densely packed refrigerating channels formed in gravel, concrete, asphalt, aluminium or plastic. An ice layer of 25–60 mm in thickness is frozen on the rink surface. Heat transmitted from the surroundings and absorbed in the surface ice is transported towards the colder refrigerating channels. Adjustment of the temperature in the refrigerating channels will thus regulate the refrigerating effect or capacity of the rink. When the texture difference between surface ice and refrigerating channels is increased, the traction of heat towards the channels and through the rink structure will also increase. This is achieved in practice by incorporating several power stages on the compressors of the refrigerating machine, these compressors functioning to cool down the channel-carried refrigerant to lower temperatures.

In order to maintain the surface ice at a constant temperate, it is necessary to cool off the same amount of heat as that absorbed in the surface. Thus, there must be maintained continuously a refrigerating effect which corresponds to the prevailing heat load on the ice surface.

This is very difficult to achieve and the surface ice will more often than not be at the wrong temperature. The heat load on the surface ice of an outdoor rink can vary from −50 W/square meters in natural cold to +25 W/square meters at high daytime temperatuers and as a reuslt of the influence of the sun's rays, during one and the same calendar day. In the case of enclosed ice rinks, the heat load during matches and while rinsing or washing the ice with water between periods of play can reach to above 200 W/square meters and then at some time prior to or after the matches reach to only about 50 W/square meters. The extent of the difficulty in continuously varying the refrigerating effect to correspond to the heat load is quite obvious.

Even though a surface ice temperate of −2° C. will generate the lowest friction, there are other reasons why other temperatures are desirable during a normal day's operation. When the ice rink is not in use, during daytime periods and also during nighttime periods, the surface ice may be permitted to take a higher temperature, e.g. −0.5° C., so as to reduce the refrigerating capacity required. Mechanical planning of the surface ice in the daytime is also facilitated when the surface ice is relatively warm. When the ice is used for iceskating during a daytime period, a surface temperature of immediately beneath −1° C. is desirable, so that the skates will obtain better purchase when executing swings and jumps. When speed skating on enclosed ice rinks, for instance short distance skating, the ice temperature shall lie close to −2° C. In the case of intensive use when playing ice-hockey where several matches are played one after the other, the temperature of the ice surface should be somewhat more than −3° C. so that, among other things, the roughly 500 liters of hot water deposited by the ice maintenance machine at the end of each period will freeze more rapidly. The ice layer tends to become thicker during its operational time. It is difficult to maintain a balance between applying water and planing the surface of the ice. In practice, the thickness of the ice layer will grow from about 30 mm at the beginning of the season to about 60 mm or more six to nine months later. An ice layer of increased thickness requires further reduction in the temperature of the refrigerating channels in order to compensate for the drop in temperature through the thicker ice layer. Furthermore, different rink constructions have different internal resistances to heat transportation.

Thus, the temperate level in the channels with heat load on the ice surface, the thickness of the ice layer and the desired temperature of the ice surface will vary for a given rink construction. As will have been understood from the aforegoing, this presents a temperature control problem which has not been solved satisfactorily hitherto.

Thus, conventional, present-day techniques intended for adjusting or controlling the temperature of the surface ice of artificially frozen ice rinks often record wrong temperatures and result in uneconomic operation of the refrigerating system concerned. The known technique can be divided essentially into three alternatives.

1) Manual measurement of the surface temperature and continuous adjustment of the refrigerating capacity or effect by activating and deactivating the power stages of refrigerating compressors. This requires experience and continuous monitoring. Such plants will often employ up to five different persons on each shift. This alternative is therefore exepensive and the result uncertain.

2) Automatic power control on the basis of measuring the temperature of the refrigerant return line connected over the drive thermostat. Adjustments made for assumed, suitable control values, or set-point values, of the refrigerant, e.g. −8° C. When the temperature falls to −7° C., the refrigerant system is started-up and continues to run until the refrigerant has reached a temperature of −8° C. Since the total amount of circulating heat transfer medium has small specific heat, the temperate is lowered rapidly and so does its heating in the warmer path. The result is often short stopping and starting intervals, with large wear and tear on machine components. Furthermore, it is necessary for the circulation pumps to operate continuously, so as to enable the return temperature of the heat transfer medium to be measured for the purpose of controlling compressors, even when it is not necessary to cool the surface ice at that particular time.

When fixed set-point values are used, the surface ice will be too warm in the case of high heat loads and too cold in the case of low heat loads. In certain cases, the thermostat value is adjusted manually, prior to a large event, on the basis of experience, sometimes with a slightly improved result. The heat load does not vary so radically in outdoor ice rinks as in indoor ice rinks, and is therefore totally dependent on changes in weather. The degrees of difficulty are further increased in this case.

3) In a few systems, a temperature sensor has been placed in the rink covering surface over the refrigerating channels and thus replaced the temperature sensor that projects into the refrigerant path. Since the thermal mass of the rink construction is greater than the thermal mass of the refrigerant, the intervals between starting and stopping of the refrigerating machine will be longer. Hitherto, the temperature of the surface ice and the prevailing refrigerating requirements have not been monitored automatically.

For practical reasons, the temperature sensor cannot be moved to a higher level in the actual ice layer itself, due to risk of damage when the skate blades are dug deeply into the ice, etc.

None of the aforesaid methods provides the necessary measurement values on which optimal and automatic control of prevailing refrigerating requirements can be based and also the control of the surface ice temperature towards desired temperature values.

The present invention relates to a method and to a system for measuring the temperature of surface ice so that said temperature can be adjusted accurately as required, this temperature adjustment being included in the inventive embodiments.

The invention enables the temperature of ice to be adapted optimally for different areas of use. The invention is reproducible and highly flexible and affords a much improved operating economy.

The invention thus relates to a method for measuring and adjusting the temperature of the surface in artificial ice rinks, in which water is frozen to ice with the aid of refrigerating channels disposed in the rink and through which refrigerant is passed by means of a refrigerating machine or system, and in which the ice temperature is regulated or adjusted by adjusting the refrigerating effect or refrigerating capacity of the refrigerating system.

The method is mainly characterized by measuring the temperature of the surface ice with the aid of at least one sensor which functions to measure infrared radiation from said surface ice, and processing the signals produced by the sensor in a control unit which controls the refrigerating machine in a manner to adapt the temperature of the surface ice to a predetermined temperature level.

The invention also relates to a system for measuring and controlling the temperature of surface ice in artificial ice rinks, in which water is intended to be frozen to ice by means of refrigerating channels disposed in the rink and through which refrigerant is passed by means of a refrigerating machine, and in which means are provided for adjusting the ice temperature by corresponding adjustment of the refrigerating effect, or refrigerating capacity, of the refrigerating plant.

The system is mainly characterized by means for measuring the temperature of surface ice with the aid of at least one sensor which functions to measure infrared radiation from the surface ice, and by a control unit which is intended to control the refrigerating machine in a manner to adapt the temperature of the surface ice to a predetermined temperature level.

Figure 2:
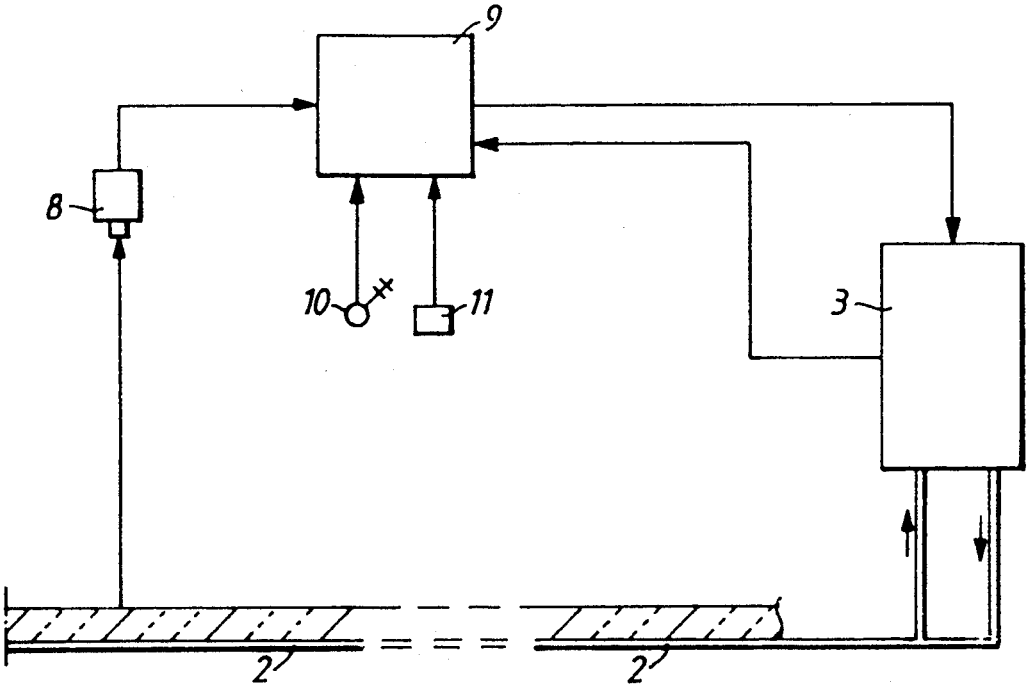

The invention will now be described in more detail with reference to an exemplifying embodiment thereof and also with reference to the accompany drawings, in which FIG. 1 is a principle illustration of an ice rink with a refrigerating system, seen from above; and FIG. 2 illustrates schematically a first embodiment of apparatus for measuring and adjusting the temperature of the surface ice of the rink.

FIG. 1 illustrates schematically an ice rink 1 which is provided with refrigerating channels 2 through which a refrigerant passes. The rink construction includes a known refrigerating system or machine, comprising a pump section 4, a compressor section 5, a condensor section 6 and a heat exchanger 7, said system functioning to cool the refrigerant and to circulate the same in the channels 2 so as to freeze to ice water located in the vicinity of the channels. The refrigerating system 3 is constructed so as to enable the temperature of the surface ice to be adjusted by appropriate adjustment of the cooling effect, or refrigerating capacity, of the refrigerating system.

As will be seen from FIG. 2, the system includes a sensor 8 which functions to measure infrared radiation emitted from the surface ice, for the purpose of measuring the temperature of said surface ice. The system includes at least one sensor although it is conceivable to install a plurality of sensors, so as to enable the surface ice temperature to be measured over different parts of the rink. Since the sensor measures the ice temperature without being in contact with the ice, the sensor can be mounted at an appropriate height above the rink surface.

The sensor is intended to measure the ice temperature over a relatively restricted area, for instance an area of about 0.1–1 square meter, so as to avoid disturbances resulting from the presence of foreign objects, such as players, etc., among other things. This restriction may be achieved with the aid of a suitable lens system, for instance.

The exemplifying embodiment illustrated in FIG. 2 also includes a control unit 9 which is intended to control the refrigerating system or machine in a manner to adapt the temperature of the surface ice to a predetermined level. In this case, the sensor 8 is intended to deliver to the control unit a signal which indicates the prevailing temperature of the ice, wherein occurrent temperature deviations are intended to form the basis on which the real values are determined for adjustment of the surface ice temperature by means of the control unit and the refrigerating system.

Devices, preferably included in the control unit 9, are provided for recording the temperature-time sequence of the surface ice, wherein the control unit is constructed to store predetermined temperature-time sequences and to compare the measured and recorded temperature-time sequences with the stored temperature-time sequences.

Means are also provided for calibrating the sensor or sensors 8, these means also preferably being included in the control unit 9. In this case, calibration is intended to be effected in conjunction with rinsing or washing the rink with water, wherein the freshly applied water is assumed to adopt a temperature of 0° C. after a short transition period. The time point at which the temperature of the water is assumed to be 0° C. is determined by giving the temperature which is measured after a measured, rapid temperature increase of given predetermined amplitude and a subsequent, relatively rapid temperature decrease the value of 0° C. This will also enable a comparison to be made with predetermined, stored temperature sequences.

The control unit is preferably constructed to correct the signal from the sensor 8 with regard, inter alia, to the influence of air temperature and air humidity in the close proximity of the rink ice, said control unit preferably being constructed to use empirically determined and stored relationships. The reference 10 identifies means for measuring air temperature while the reference 11 identifies means for measuring air humidity. In this case, changes in the emissivity number of the surface ice are taken into account, said emissivity number being effected by said parameters.

In order to provide a purposeful and energy lean control function, the control unit is preferably constructed so as to initiate a first, smaller refrigerating effect when detecting a predetermined deviation from a selected set-point value, and to increase this refrigerating effect, or refrigerating power, when a predetermined temperature decrease fails to occur after a predetermined time lapse.

According to one preferred embodiment, used in the case of ice-hockey rinks, the temperature of −2° C. is used as a set-point value for the surface ice temperature.

The inventive method and the method of operation of the inventive system will be understood in all essentials from the above description. It will also be understood that because the temperature of the surface ice is measured and adjusted directly with the aid of sensors of the aforedescribed kind, the properties of the surface ice cannot be directly influenced by the sensors.

It will also be understood that the inventive method and inventive system afford considerable advantages of the known prior art. For example, the invention enables the properties of the surface ice to be varied in a highly flexible and precise fashion. Furthermore, the fact that the surface ice temperate can be accurately adjusted enables the refrigerating system to be operated at optimum energy inputs and therewith at the best possible energy economies.

The invention bas been described in the aforegoing with reference to exemplifying embodiments thereof. It will be understood, however, that other embodiments and minor modifications are conceivable without departing from the inventive concept.

For example, more than one sensor can be used, in which case the measuring values obtained with the different sensors can be either used to form a mean value or can be used separately.

I claim:

1. A method for measuring and adjusting the temperature of ice of artificial ice rinks, in which water is frozen to ice with the aid of refrigerating channels disposed in the rink and in which refrigerant is passed through the refrigerating channels by means of a refrigerating system, and in which the temperature of the ice is adjusted by adjusting the refrigerating effect of the refrigerating system, characterized by measuring the surface temperature of the ice with the aid of at least one sensor which functions to measure infrared radiation from the surface ice, and by processing the signals produced by said sensor in a control unit which controls the refrigerating system in a manner to bring the surface ice to a predetermined temperature; and by calibrating the sensor in conjunction with rinsing or washing the rink with water, the water being assumed to take a temperature of 0° C. after a short transition period.

2. A method according to claim 1, characterized by giving the temperature which is measured at a predetermined time after a rapid increase in temperature of given amplitude and a subsequent relatively rapid drop in temperature the value of 0° C. for calibration purposes.

3. A method of controlling the temperature of ice in an artificial ice rink having refrigeration channels through which refrigerant is passed using a refrigerating system, comprising the steps of:

(a) passing refrigerant through the refrigeration channels to cause ice to form in the artificial ice rink, the ice including an ice surface which contacts the blades of skates of skaters using the ice rink;

(b) sensing the temperature of the ice surface from a location above the ice surface; and (c) in response to the sensing from step (b), controlling the refrigerating system so as to maintain the ice surface temperature at an optimum value for a specific use to which the ice rink is put.

4. A method as recited in claim 3 wherein step (c) is practiced to control the temperature of the ice surface so that it is −2° C.

5. A method as recited in claim 3 wherein step (b) is practiced to sense the temperature of the ice surface over an area of between 0.1–1 meters.

6. A method as recited in claim 5 wherein step (b) is practiced by measuring the infrared radiation emanating from the ice surface.

7. A method as recited in claim 4 wherein step (b) is practiced by measuring the infrared radiation emanating from the ice surface.

8. A method as recited in claim 3 wherein step (b) is practiced by measuring the infrared radiation emanating from the ice surface.

9. A method as recited in claim 8 wherein step (b) is practiced using at least one infrared sensor, and comprising the further step of calibrating the sensor in conjunction with rinsing or washing the rink with water, the water being assumed to reach a temperature of 0° C. after a short transition period.

10. A method as recited in claim 8 wherein step (b) is practiced by giving the temperature which is measured at a predetermined time after rapid increase in temperature of given amplitude and a subsequent relatively rapid drop in temperature the value of 0° C. for calibration purposes.

11. An artificial ice rink assembly, comprising:

a refrigeration system, including a plurality of refrigeration channels through which refrigerant is passed by the refrigeration system;

a control unit for controlling the refrigeration system for controlling passage of refrigerant through the refrigeration channels to control the formation and temperature of ice in the artificial ice rink, the ice having an ice surface which contacts the blades of skaters using the ice rink; and an infrared sensor for sensing infrared radiation emanating from the ice surface, and thus the temperature of the ice surface, and sending signals to said control unit in response to said ice surface temperature sensing, so that said control unit controls said refrigeration system to maintain the temperature of the ice surface at a desired value.

12. An artificial ice rink assembly as recited in claim 11 wherein said infrared sensor comprises a plurality of infrared sensors, disposed above the ice surface.

13. An artificial ice rink assembly as recited in claim 11 wherein said infrared sensor is positioned with respect to the ice surface to measure the infrared radiation emanating from an area of the ice surface between 0.1–1 meters.

14. An artificial ice rink assembly as recited in claim 11 wherein said control unit comprises means for initiating a first refrigerating power output when detecting a predetermined deviation from a chose set-point value, and to initiate a further refrigerating power output when failing to detect a predetermined temperature decrease after a predetermined time lapse.

15. An artificial ice rink assembly as recited in claim 11 further comprising means for recording the temperature-time sequence measured by said infrared sensor, and wherein said control unit compares the recorded temperature-time sequence with predetermined temperature time sequences.

16. An artificial ice rink assembly as recited 11 further comprising means for giving the temperature which is measured at a predetermined time after a rapid increase in temperature of given amplitude and a subsequent relatively rapid drop in temperature the value of 0° C. for calibration purposes.

17. An artificial ice rink assembly as recited in claim 11 further comprising sensor calibrating means for calibrating said sensor in conjunction with rinsing or washing the rink with water, wherein the water is assumed to have adopted the temperature of 0° C. after a short transition period.

* * * * *